US006128806A

United States Patent [19]

Shou-Mao

[11] Patent Number: 6,128,806

[45] Date of Patent: Oct. 10, 2000

[54] ASSEMBLY OF EXPANDABLE PULL RODS OF LUGGAGE

[76] Inventor: Chen Shou-Mao, 344, Section 1, Chung Shan Road, Ta Cha Township, Taichung Hsien, Taiwan

[21] Appl. No.: 09/265,015

[22] Filed: Mar. 9, 1999

[51] Int. Cl.[7] ..... A45C 7/00

[52] U.S. Cl. ..... 16/113.1; 280/655; 280/47.315

[58] Field of Search ..... 16/113.1, 429, 16/405; 190/115, 18 A; 280/655, 655.1, 47.315, 47.317; 403/109, 377

[56] References Cited

U.S. PATENT DOCUMENTS 5,692,266 12/1997 Tsai ..... 16/113.1
5,704,725 1/1998 Horing ..... 16/113.1
5,806,143 9/1998 Tsai ..... 16/113.1
5,893,196 4/1999 Tserng ..... 16/113.1
6,025,543 2/2000 Chen ..... 16/113.1

*Primary Examiner*—Chuck Y. Mah
*Attorney, Agent, or Firm*—Harrison & Egbert

[57] ABSTRACT

An assembly of expandable pull rods of an article of luggage including an expandable pull rod frame, an arresting device, and a press member. The expandable pull rod frame is formed of a bottom seat for bracing two bottom tubes into which two intermediate tubes are fitted. Two top tubes are fitted into the two intermediate tubes and are fastened with a hand grip. The top tubes and the intermediate tubes are located by the main control members of the arresting device, whereas the intermediate tubes and the bottom tubes are located by the auxiliary control members of the arresting device. The press member is disposed in the hand grip for actuating the arresting device.

2 Claims, 8 Drawing Sheets

ASSEMBLY OF EXPANDABLE PULL RODS OF LUGGAGE

FIELD OF THE INVENTION

The present invention relates generally to luggage, and more particularly to an assembly of expandable pull rods of the luggage.

BACKGROUND OF THE INVENTION

Conventional luggage is generally provided with two expandable pull rods to facilitate the moving of the luggage on a surface with one hand. The two expandable pull rods are connected by a hand grip. The expandable pull rods can be extracted and retracted to meet the requirements of persons of all sizes. In addition, the expandable pull rods can be retracted such that the luggage can be easily transported on a carrier, such as a boat, train, airplane, etc. The conventional expandable pull rods are generally complicated in construction and are therefore not cost-effective.

SUMMARY OF THE INVENTION

It is therefore the primary objective of the present invention to provide an article of luggage with expandable pull rods which are relatively simple in construction.

It is another objective of the present invention to provide an article of luggage with expandable pull rods which are cost-effective.

It is still another objective of the present invention to provide an article of luggage with expandable pull rods which are ease to use.

In keeping with the principle of the present invention, the foregoing objectives of the present invention are attained by an assembly comprising two expandable pull rods, and a mechanism for controlling and locating the two expandable pull rods. The mechanism comprises a press member and an arresting device. The press member is disposed in a hand grip which connects the top ends of the two expandable pull rods. The arresting device is controlled by the press member.

The foregoing objectives, features, functions, and advantages of the present invention will be more readily understood upon a thoughtful deliberation of the following detailed description of the preferred embodiments of the present invention with reference to the accompanying drawings.

DETAILED DESCRIPTION OF THE EMBODIMENTS

Figure 1:
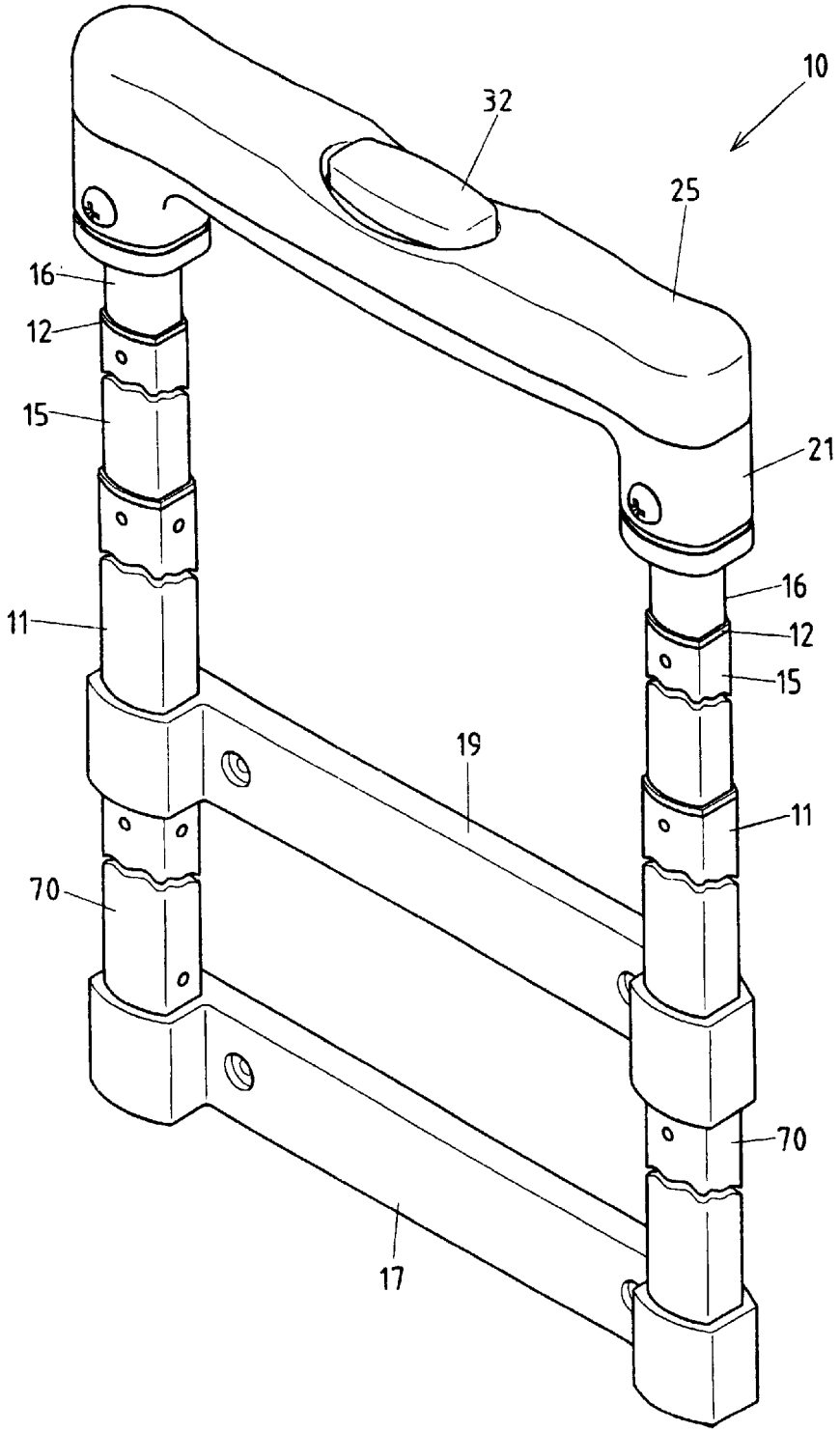
FIG. 1 shows a perspective view of a first preferred embodiment of the present invention.
Figure 2:
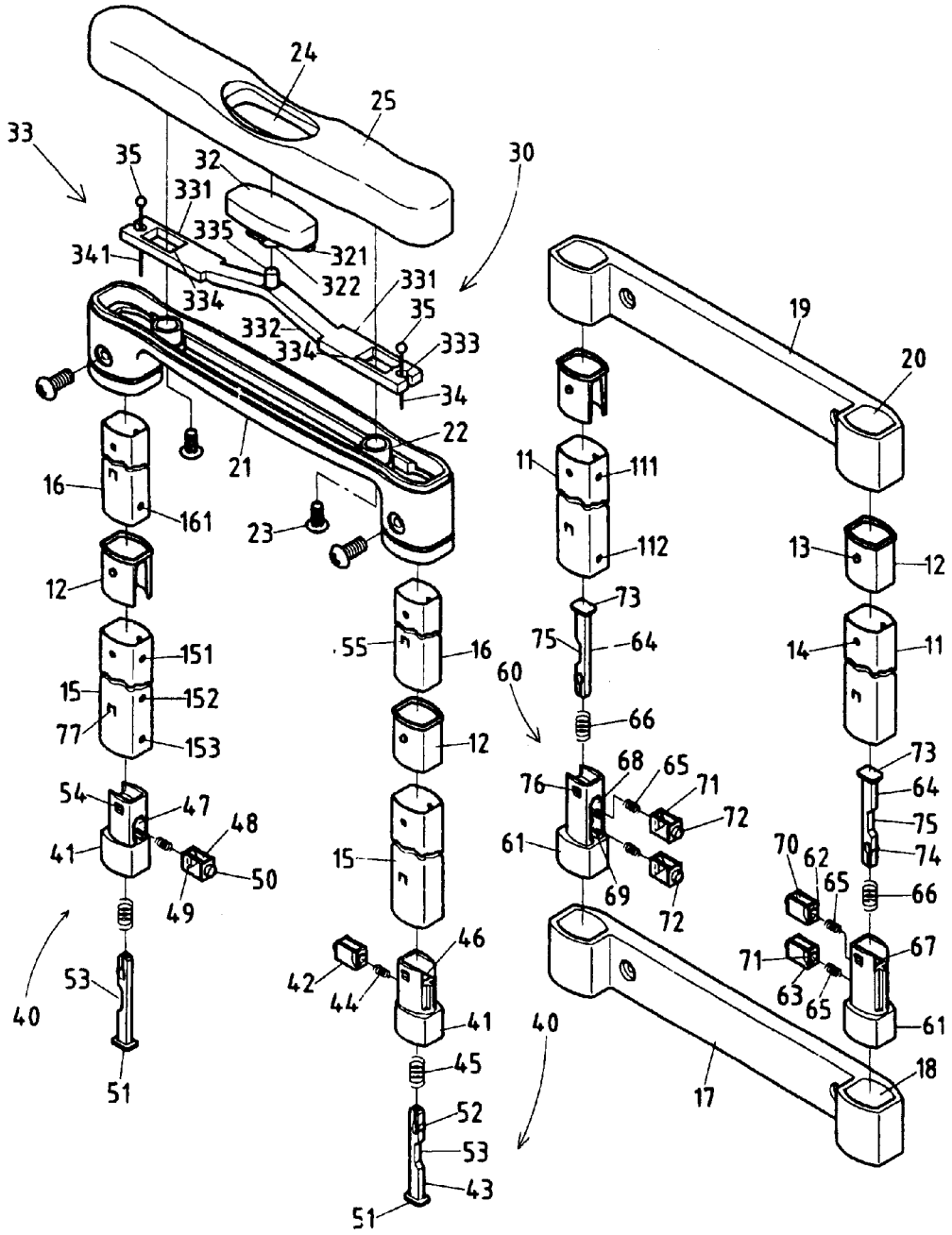
FIG. 2 shows an exploded view of the first preferred embodiment of the present invention.

As shown in FIGS. 1 and 2, an expandable pull rod assembly embodied in the present invention is intended for use in conjunction with an article of luggage and is essentially composed of an expandable pull rod frame 10 comprising a press member 30 and an arresting device 40. The expandable pull rod frame 10 comprises the component parts which are described hereinafter.

Two bottom tubes 11 are of a hollow construction and are respectively provided at the top end thereof with a locating sleeve 12 having on the outer wall thereof a protuberance 13. The two bottom tubes 11 are further provided with two locating holes 111 and 112.

Two intermediate tubes 15 are of a hollow construction and are fitted from the bottom end thereof into the bottom tubes 11 such that the top ends of the intermediate tubes 15 are jutted out of the top ends of the bottom tubes 11. The intermediate tubes 15 are provided at the top ends thereof with a locating sleeve 12 fitted thereinto. The intermediate tubes 15 are further provided in the top thereof and the bottom thereof with a plurality of locating holes 151, 152, 153.

Two top tubes 16 are of a hollow construction and are fitted into the top ends of the intermediate tubes 15 such that the top ends of the top tubes 16 are jutted out of the top ends of the intermediate tubes 15. The two top tubes 16 are respectively provided in the bottom thereof with a locating hole 161.

A bottom seat 17 is provided at both longitudinal ends thereof with a retaining slot 18 in which the bottom end of the bottom tubes 11 is retained.

An intermediate seat 19 is provided at both longitudinal ends thereof with a through hole 20 in which the top end of the bottom tubes 11 is located and in which the intermediate tube 15 and the top tube 16 are received.

A hand grip 21 is provided at both longitudinal ends thereof with a retaining slot (not shown in the drawings) for locating the top end of the top tube 16. The hand grip 21 is further provided in the upper side thereof with two pillars 22 contiguous respectively to both longitudinal ends of the hand grip 21. The hand grip 21 is further provided with a cover 25 which is fastened with the hand grip 21 by two screws 23. The cover 25 is provided at the center thereof with a through hole 24. The press member 30 is disposed between the hand grip 21 and the cover 25.

The arresting device 40 comprises two main control members 40 and two auxiliary control members 60.

The two main control members 40 are connected in the bottom ends of the two top tubes 16 and are composed of a seat block 41, a locating block 42, an arresting block 43, a horizontal return spring 44, and a longitudinal return spring 45. The seat block 41 is provided with a longitudinal hole 46, and two cross slots 47 which are opposite in location to each other. The horizontal return springs 44 and the locating blocks 42 are disposed in the cross slots 47. Each locating block 42 has a longitudinal through hole 48 in communication with the longitudinal hole 46 of the seat block 41. The inner side wall of the longitudinal through hole 48 is provided with an inclined guide block 49. The locating blocks 42 are provided in the outer side thereof with a cross round protrusion 50. The two locating blocks 42 are disposed in the cross slots 47 of the two seat blocks 41 such that the two cross round protrusions 50 are opposite to each other. The arresting blocks 43 are provided at the bottom thereof with a stop piece 51 and are fitted into the longitudinal return spring 45 before being disposed in the longitudinal through hole 48 of the locating block 42 such that the top ends of the arresting blocks 43 are jutted out of the top ends of the seat block 41, and that the top ends of the arresting blocks 43 are fastened respectively with two pull cords 34 and 341. The arresting blocks 43 are provided at the top ends thereof with a retaining hook 52. The arresting blocks 43 are further provided at the center thereof with an inclined guide slot 53 corresponding in location to the inclined guide block 49. The seat blocks 41 are provided at the top thereof with a retaining slot 54 in which a retaining block 55 of the top tubes 16 is retained, thereby enabling the cross round protrusion 50 of the locating block 42 to jut out of the locating hole 161 of the top tubes 16.

The two auxiliary control members 60 are disposed in the bottom ends of the two intermediate tubes 15. Each auxiliary control member 60 comprises a lower seat block 61, an upper locating block 62, a lower locating block 63, a lower arresting block 64, two horizontal return springs 65, and one longitudinal return spring 66. The lower seat block 61 is provided with a straight long hole 67 and two cross slots 68 and 69 in which the horizontal return springs 65 are disposed. The upper locating block 62 is provided with a straight through hole 70, whereas the lower seat block 61 is provided with a straight long hole 67 in communication with the straight through hole 70. The straight through hole 70 is provided in the inner wall thereof with an inclined protrusion 71. The upper and the lower locating blocks 62 and 63 are provided in the outer sides thereof with a cross protuberance 72. The lower arresting block 64 is provided at the top end thereof with a seat piece 73 and is fitted into the longitudinal return spring 66 before being disposed in the straight through holes 70 of the upper and the lower locating blocks 62 and 63 such that the bottom end of the lower arresting block 64 is jutted out of the bottom end of the lower seat block 61. The lower arresting block 64 is provided at the bottom end thereof with a retaining protrusion 74, and at the center thereof with an inclined guide slot 75 corresponding in location to the inclined protrusion 71 of the upper locating block 62. The lower seat block 61 is provided at the top thereof with a retaining slot 76. The lower seat block 61 is located in the bottom end of the intermediate tube 15 such that the retaining piece 77 is retained in the retaining slot 76, and that the seat piece 73 of the arresting block 64 faces the bottom edge of the seat block 41 of the main control member 40.

The press member 30 comprises a press key 32, a control block 33, and two pull cords 34 and 341. The press key 32 is provided in the underside thereof with a plurality of inverted hooks 321, and a position confining pillar 322. The press key 32 is joined with the cover 25 such that the inverted hooks 321 of the press key 32 catch the periphery of the through hole 24 of the cover 25. The control block 33 is formed of a guide block 331 and an elastic piece 332 and is provided with two retaining holes 333 for retaining two spherical ends 35 of the two pull cords 34 and 341 which are disposed in the two top tubes 16. The guide block 331 is provided with a guide hole 334 greater in size than the pillar 22 of the hand grip 21. The elastic piece 332 is provided with a guide pillar 335, which is fitted into the position confining pillar 322 of the press key 32. In the meantime, the two pillars 22 of the hand grip 21 are received in the guide holes 334 of the two guide blocks 331.

Figure 3:
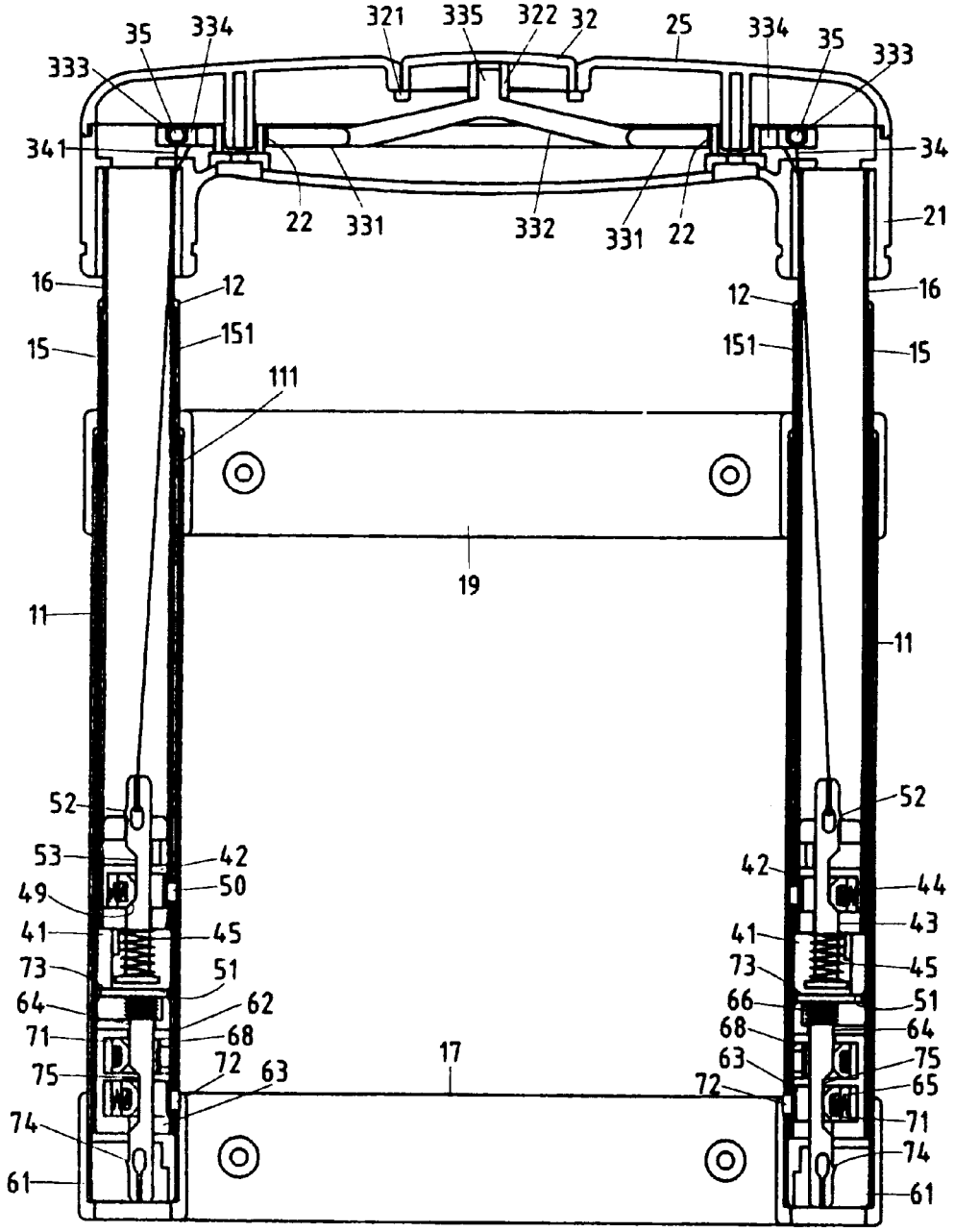
FIG. 3 shows a sectional schematic view of the present invention in the retraction state.
Figure 4:
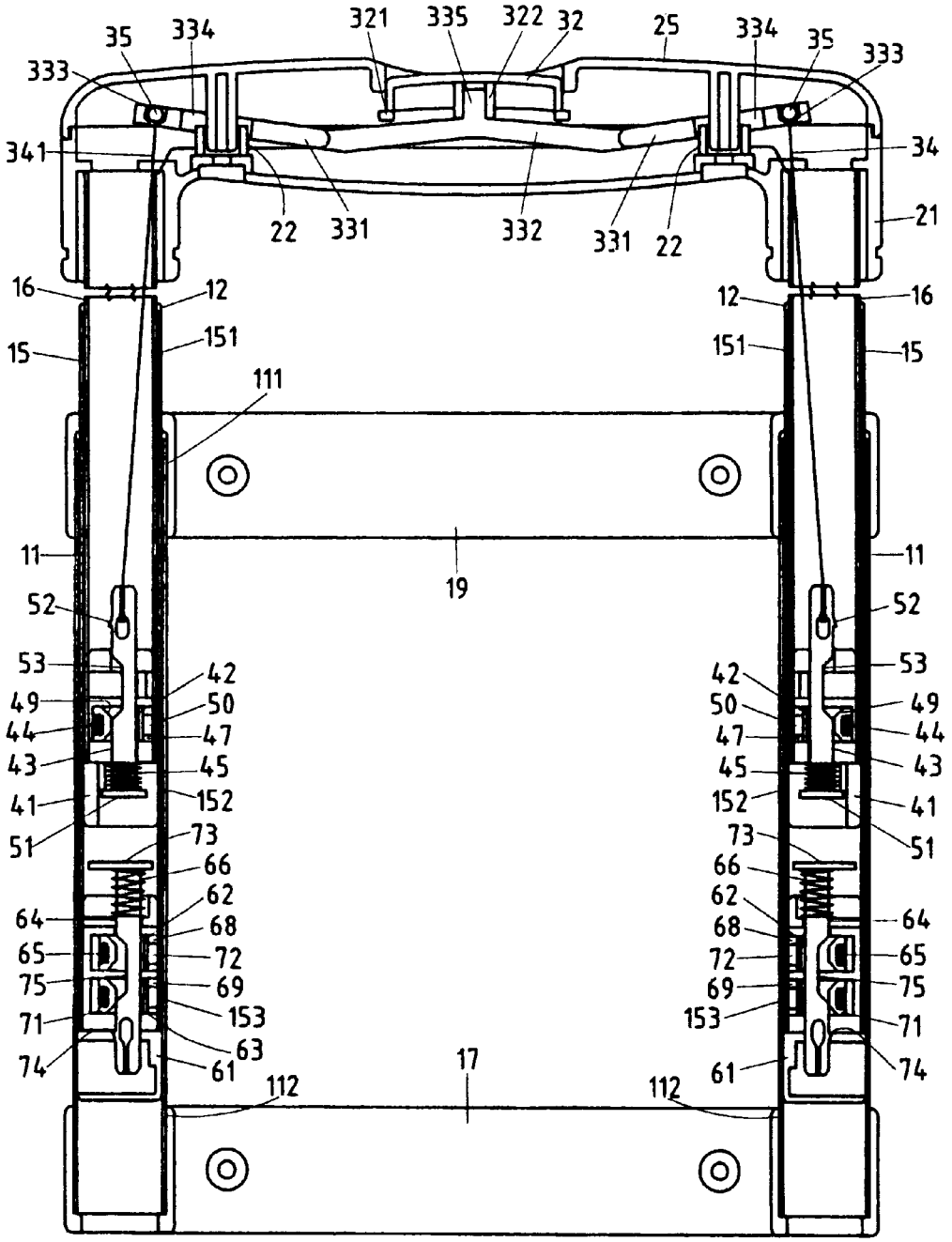
FIG. 4 shows a sectional schematic view of the present invention in the extraction state.

As shown in FIGS. 2, 3, and 4, when the present invention is in the retraction state, the top tubes 16 and the intermediate tubes 15 are retracted into the bottom tubes 11. In the meantime, the lower arresting block 64 of the auxiliary control member 60 is pressed downward by the bottom block 41 of the main control member 40, so as to enable the inclined protrusion 71 to slide along the inclined guide slot 75 of the lower arresting block 64 such that the upper locating block 62 is caused to retract inwardly and horizontally, and that the lower locating block 63 is caused to extend outwardly and horizontally to enable the cross protuberance 72 of the lower locating block 63 to be retained in the locating holes 153 and 112 of the intermediate tubes 15 and the bottom tubes 11. The cross round protrusions 50 of the locating blocks 43 of the main control member 40 are respectively located in the locating hole 161 of the top tubes 16 and the locating hole 152 of the intermediate tubes 15. In other words, the top tubes 16 and the intermediate tubes 15 are located by the main control member 40, whereas the intermediate tubes 15 and the bottom tubes 11 are located by the auxiliary control members 60. The top tubes 16 and the intermediate tubes 15 are securely located such that the expandable pull rod frame 10 is securely retracted.

Figure 5:
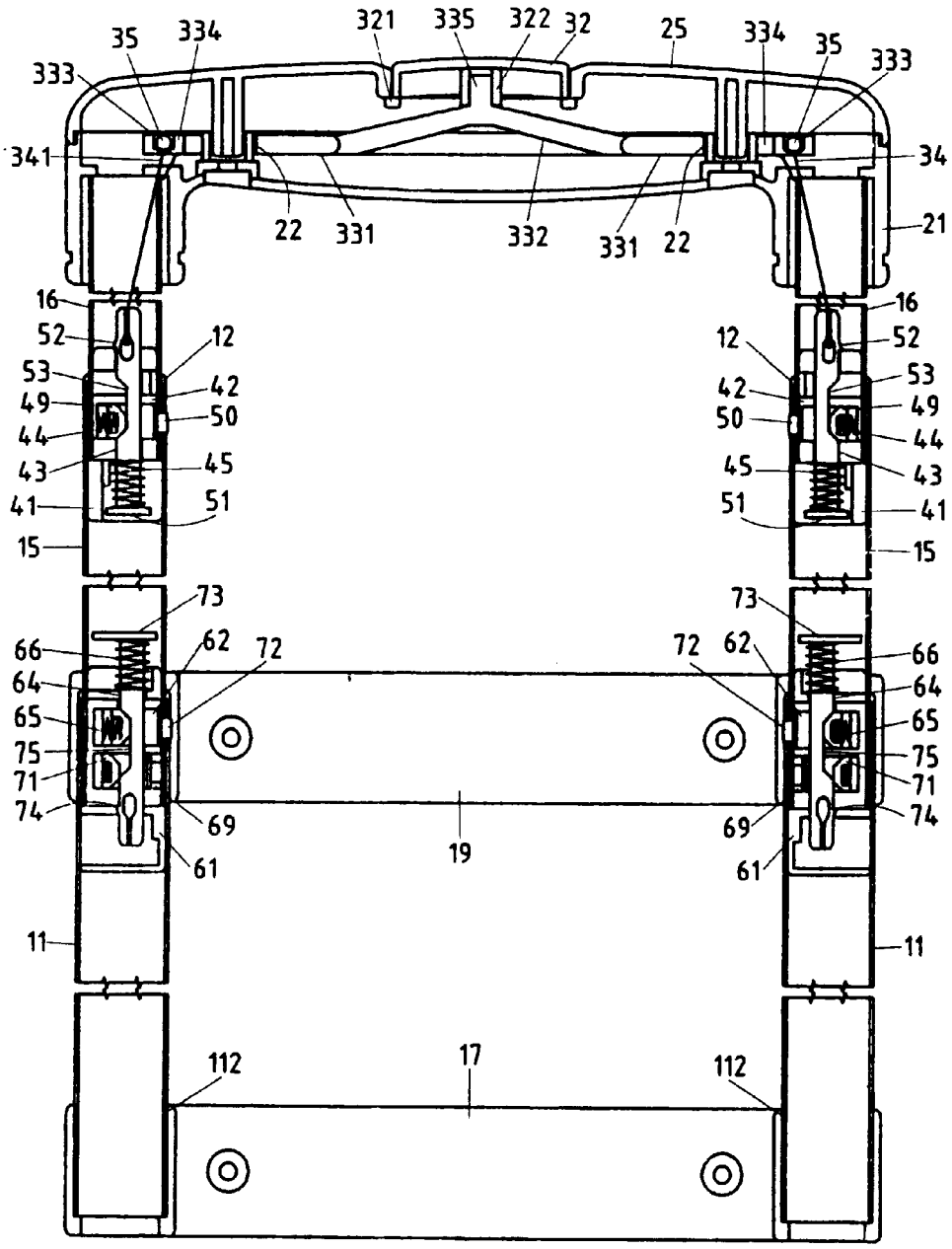
FIG. 5 shows a sectional schematic view of the present invention in a locating state.

Now referring to FIGS. 4 and 5, before the expandable pull rod frame 10 is extracted, the press key 32 must be first pressed to enable the position confining pillar 322 to actuate the guide pillar 335 and the elastic piece 332 of the control block 33 such that the guide blocks 331 of the control block 33 are caused to move upwards. As a result, the two pull cords 34 and 341 are pulled upwards to actuate the arresting blocks 43 of the main control members 40 to displace upwards such that the inclined guide blocks 49 of the locating blocks 42 are pushed by the inclined guide slots 53 of the arresting blocks 43 to move inwards, thereby resulting in the disengagement of the cross round protrusions 50 of the locating blocks 42 with the locating holes 152 of the intermediate tubes 15. As a result, the top tubes 16 can be pulled upwards by the hand grip 21. In the meantime, the seat block 41 of the main control member 40 is also caused to displace upwards so as to release the lower arresting block 64 of the auxiliary control member 60 such that the lower arresting block 64 is pushed upwards by the elastic force of the longitudinal return spring 66. As a result, the cross protuberance 72 of the lower locating block 63 is actuated by the inclined guide slot 75 of the lower arresting block 64 to disengage the locating hole 112 of the bottom tube 11. When the top tube 16 is pulled out of the intermediate tube 15, the intermediate tube 15 is also pulled out of the bottom tube 11. The top tube 16 and the intermediate tube 15 are located such that the locating block 42 of the main control member 40 and the cross round protrusion 50 are retained in the locating holes 151 of the intermediate tube 15. The intermediate tube 15 and the bottom tube 11 are located such that the upper locating block 62 of the auxiliary control member 60 and the cross protuberance 72 are retained in the locating holes 111 of the bottom tube 11, as shown in FIG. 5.

Figure 6:
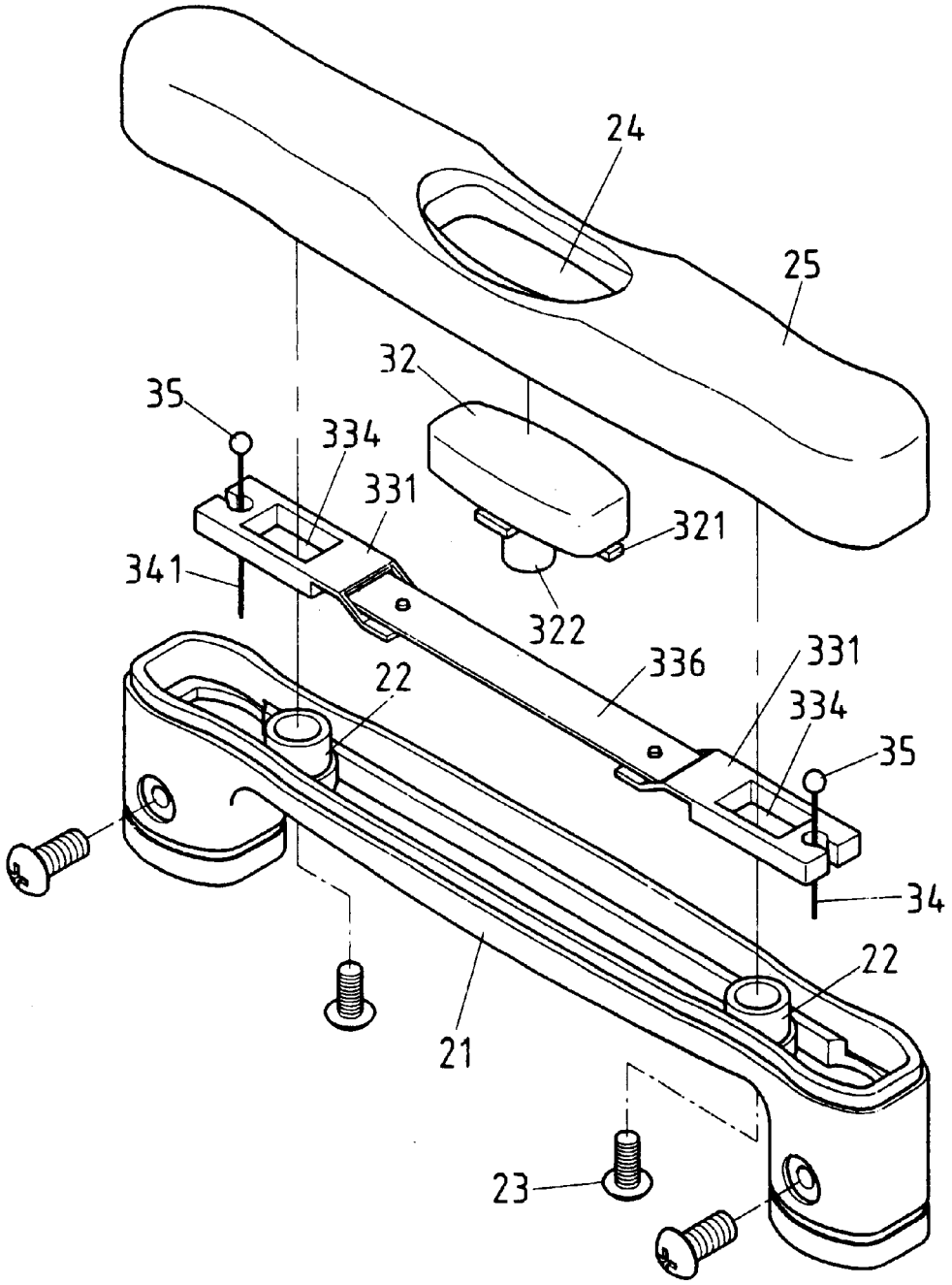
FIG. 6 shows an exploded view of a second preferred embodiment of the present invention.
Figure 7:
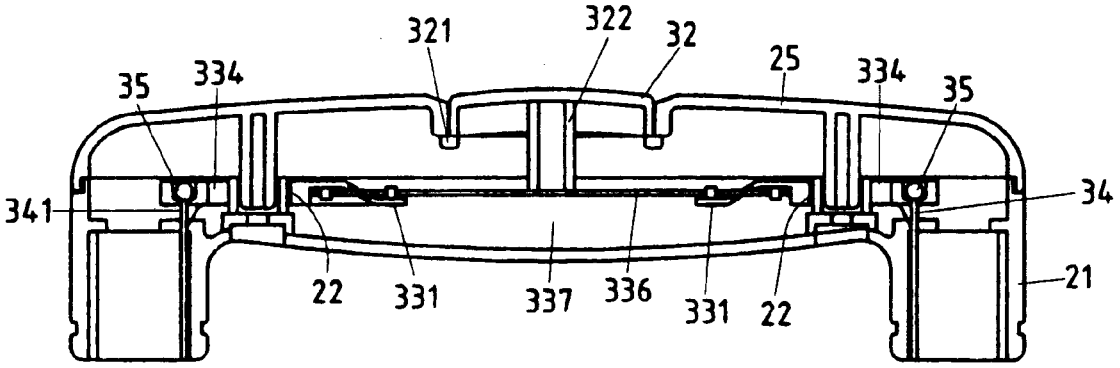
FIG. 7 shows a sectional schematic view of the second preferred embodiment of the present invention in the retraction state.
Figure 8:
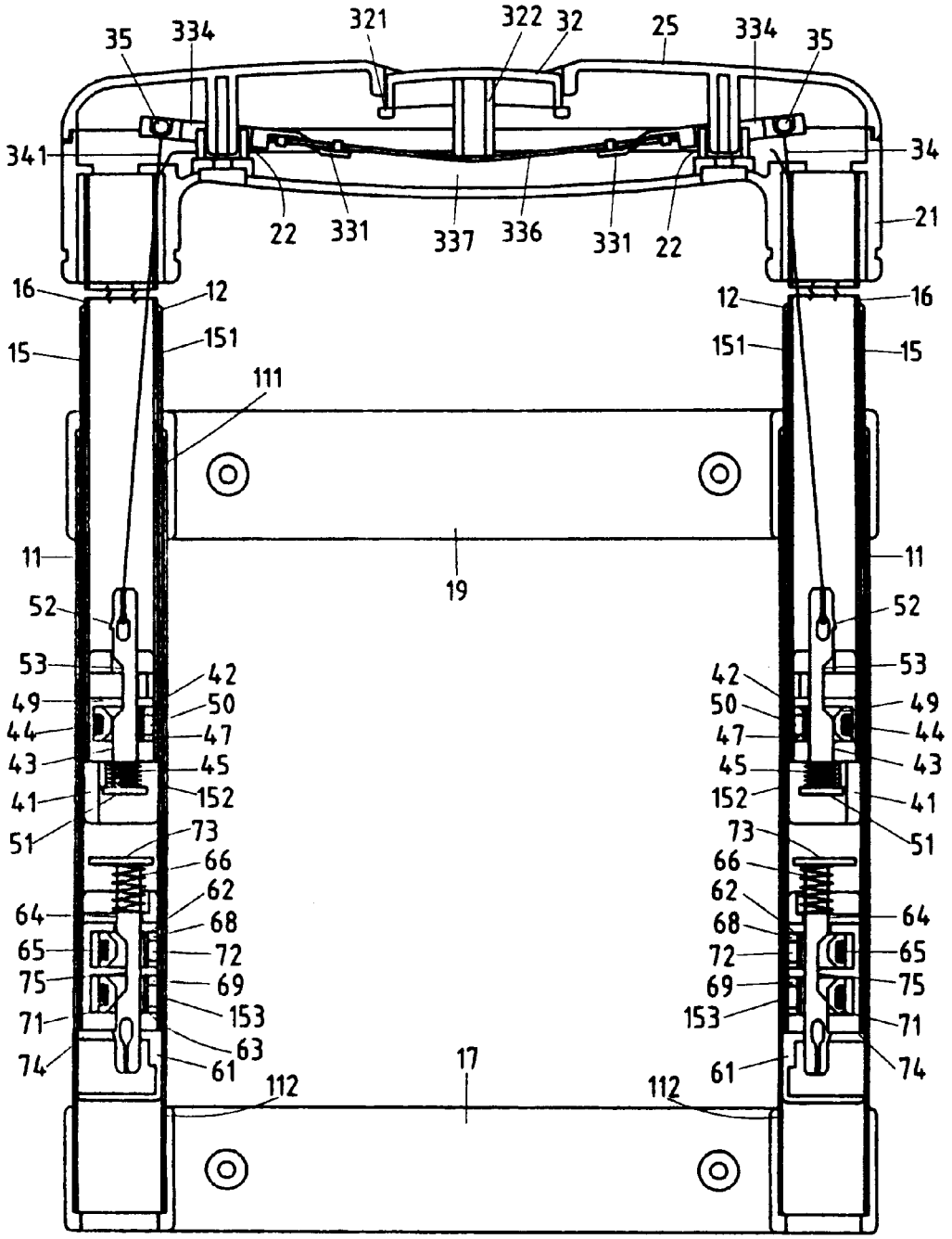
FIG. 8 shows a sectional schematic view of the second preferred embodiment of the present invention in the extraction state.

As shown in FIGS. 6, 7, and 8, the curved elastic piece 332 of the control block 33 of the press member 30 is replaced by a straight elastic piece 336, which is fastened respectively at both ends thereof with a guide block 331, thereby locating the control block 33 in the top of the hand grip 21. The underside of the straight elastic piece 336 is separated from the top of the hand grip 21 by an appropriate interval 337. The position confining pillar 322 of the press key 32 is in contact with the top of the straight elastic piece 336 such that the straight elastic piece 336 can be depressed by the position confining pillar 322 at the time when the press key 32 is pressed, and that the two guide blocks 331 are caused to displace upwards so as to pull the pull cords 34 and 341.

The embodiment of the present invention described above is to be regarded in all respects as being merely illustrative and not restrictive. Accordingly, the present invention may be embodied in other specific forms without deviating from the spirit thereof. The present invention is therefore to be limited only by the scope of the following appended claims.

What is claimed is:

1. An assembly of expandable pull rods for a piece of luggage comprising:

an expandable pull rod frame comprising:

two bottom tubes each of a hollow construction, each of said bottom tubes having a locating sleeve at a top end thereof, said locating sleeve having a protuberance on outer walls thereof, each of said bottom tubes having locating holes;

two intermediate tubes each of a hollow construction, each of said intermediate tubes being fitted into respective bottom tubes such that top ends of said intermediate tubes jut out of top ends of respective bottom tubes, said intermediate tubes having locating sleeves at respective top ends thereof, each of said intermediate tubes having a plurality of locating holes in respective top and bottom ends thereof;

two top tubes of a hollow construction, each of said top tubes being fitted into respective top ends of said intermediate tubes such that top ends of said top tubes jut out of respective top ends of said intermediate tubes, each of said top tubes having locating holes in a bottom end thereof;

a bottom seat having retaining slots at both longitudinal ends thereof such that respective bottom ends of said bottom tubes are retained in said retaining slots;

an intermediate seat having through holes at both longitudinal ends thereof such that respective top ends of each of said bottom tubes are received within said through holes and such that respective ends of either of said intermediate tubes and said top tubes are received within said through holes; and a hand grip having retaining slots at both longitudinal ends thereof for aligning respective top ends of said top tubes, said hand grip having two pillars at both longitudinal ends thereof such that said pillars correspond to respective top ends of said top tubes, said hand grip also having a cover fastened therewith and a through hole at a center thereof, wherein a button is positioned within said through hole of said cover;

an arresting device comprising:

two main control members positioned in respective bottom ends of said top tubes, said main control members comprising:

seat blocks having respective longitudinal holes and cross slots, said cross slots being positioned opposite each other, each of said seat blocks having a retaining slot in which a retaining block of said top tube is retained, locating blocks having respective longitudinal through holes in communication with said respective longitudinal holes of said respective seat blocks, said locating blocks having inclined guide blocks in an inner side wall thereof and cross round protrusions in an outer sidewall thereof, said locating blocks being disposed in said respective cross slots of said respective seat blocks such that each of said cross round protrusions of said respective locating blocks are opposite in location to each other;

arresting blocks having stop pieces at respective bottom ends thereof, retaining hooks and inclined guide slots, said inclined guide slots corresponding in location to said respective inclined guide blocks of said respective locating blocks, said arresting blocks being disposed in said respective longitudinal through holes of said respective locating blocks such that respective top ends of said arresting blocks jut out of respective top ends of said seat blocks and such that said respective top ends of said arresting blocks are fastened to respective pull cords;

horizontal return springs being disposed in said respective cross slots of said respective seat blocks; and longitudinal return springs having said respective arresting blocks fitting respectively therein; and two auxiliary control members positioned in respective bottom ends of said intermediate tubes, said auxiliary control members comprising:

lower seat blocks having straight long holes, cross slots, and retaining slots, said lower seat blocks being positioned in said respective bottom ends of said respective intermediate tubes such that retaining pieces are retained in said respective retaining slots;

pairs of horizontal return springs being disposed in said respective cross slots of said respective lower seat blocks;

upper locating blocks having straight through holes and cross protuberances, said straight through holes being in communication with said respective straight long holes of said respective lower seat blocks, said straight through holes having inner walls with inclined protrusions;

lower locating blocks having cross protuberances corresponding to said respective cross protuberances of said respective upper locating blocks;

lower arresting blocks having seat pieces, retaining protrusions and inclined guide slots, said lower arresting blocks being disposed in said respective straight through holes of said respective upper locating blocks such that respective bottom ends of said respective lower arresting blocks jut out of respective bottom ends of said respective lower seat blocks, said inclined guide slots corresponding in location to said respective inclined protrusions of said respective upper locating blocks, said seat pieces of said respective lower arresting blocks face bottom edges of said respective seat blocks of said respective main control members; and longitudinal return springs having said respective lower arresting blocks fitted therein; and a button comprising:

a press key having a plurality of inverted hooks on the underside thereof and a position confining pillar, said press key being connected to said cover such that said inverted hooks of said press key catch the periphery of said through hole of said cover; and a control block being formed of a guide block and an elastic piece, said control block having two retaining holes for retaining two spherical ends of two pull cords located in said top tubes, said guide block having a guide hole greater in size than said pillar of said hand grip, said elastic piece having a guide pillar which is fitted into said position confining pillar of said press key, said pillar of said hand grip being received in said guide holes of said two guide blocks.

2. The assembly of expandable pull rods of claim 1, wherein said control block of said button is formed of said guide block and a straight elastic piece, said straight elastic piece being fastened at both ends thereof to a guide block for positioning said control block in a top of said hand grip such that said straight elastic piece is separate from the top of said hand grip by an interval, said position confining pillar of said press key being in contact with a top end of said straight elastic piece such that said straight elastic piece is depressed by said position confining pillar at the time when said press key is pressed, and such that said two guide blocks are displaceable upwardly so as to pull said two pull cords.

* * * * *